United States Patent [19]

Breslow et al.

[11] 3,994,498

[45] Nov. 30, 1976

[54] GAME APPARATUS

[75] Inventors: Jeffrey D. Breslow, Highland Park; Eugene Jaworski, Park Ridge, both of Ill.

[73] Assignee: Marvin Glass & Associates, Chicago, Ill.

[22] Filed: Oct. 2, 1975

[21] Appl. No.: 618,903

[52] U.S. Cl. ..... 273/95 G; 273/131 B

[51] Int. Cl.[2] ..... A63F 7/04

[58] Field of Search ..... 273/95 R, 95 G, 85 R, 273/85 C, 131 B

[56] References Cited

UNITED STATES PATENTS

| | | | |
|---|---|---|---|
| 850,224 | 4/1907 | Haskell | 273/85 R |
| 935,585 | 9/1909 | Campbell | 273/85 C |
| 2,417,615 | 3/1947 | Rothe | 273/95 G |
| 3,172,664 | 3/1965 | Lohr | 273/85 R |
| 3,527,462 | 9/1970 | Span | 273/95 G |
| R18,163 | 8/1931 | Garver | 273/95 G |

*Primary Examiner*—Anton O. Oechsle
*Attorney, Agent, or Firm*—Coffee and Sweeney

[57] ABSTRACT

A game playable on the theme of checkers or the like. A frame structure has a raised playing surface with a plurality of apertures therein in a predetermined pattern. A plurality of balls, larger in diameter than the apertures and color coded for opposing players, are positionable in some of the apertures. Hammer-like impellers are used by the players to strike the balls from beneath the raised playing surface, through the apertures, to move the balls along the pattern of apertures or jump other balls.

4 Claims, 2 Drawing Figures

GAME APPARATUS

BACKGROUND AND SUMMARY OF THE INVENTION

This invention relates to a game apparatus generally playable on the theme of checkers or like schemes afforded by the disclosed structure.

Games of checkers, chess, or the like, have been known for many years. Such games utilize a generally flat game board having playing stations marked thereon over which manually manipulatable playing pieces are movable by the players of the game from one station to another. The playing pieces simply are grasped and lifted by the players of the game to move along the game board. Still other game boards of wide varieties have stations formed by recesses within which marbles or the like are movable in a predetermined path over the game board by manually grasping and lifting the marbles from station to station. This invention is directed to a new and improved, novel game of the character described wherein the playing pieces are movable from station to station by striking the playing pieces from beneath the playing surface.

More particularly, in the exemplary embodiment, a frame structure is provided defining a raised playing surface with a plurality of apertures therein in a predetermined pattern on the playing surface. A plurality of balls, larger in diameter than the apertures and color coded for opposing players, are positionable in only some of the apertures. A plurality of partitions extend upwardly from the playing surface defining a rectangular compartment surrounding each aperture to facilitate the balls coming to rest in the apertures. Upstanding flanges or walls surround the playing surface to facilitate confining the balls thereto. A hammer-like impeller is provided for each player of the game to strike the balls from beneath the raised playing surface, through the apertures, to move the balls along the pattern of apertures, jump other balls, or various other moves depending upon the scheme of play of the game.

Other objects, features and advantages of the invention will be apparent from the following detailed description taken in connection with the accompanying drawings.

DESCRIPTION OF THE PREFERRED EMBODIMENT

Figure 1:
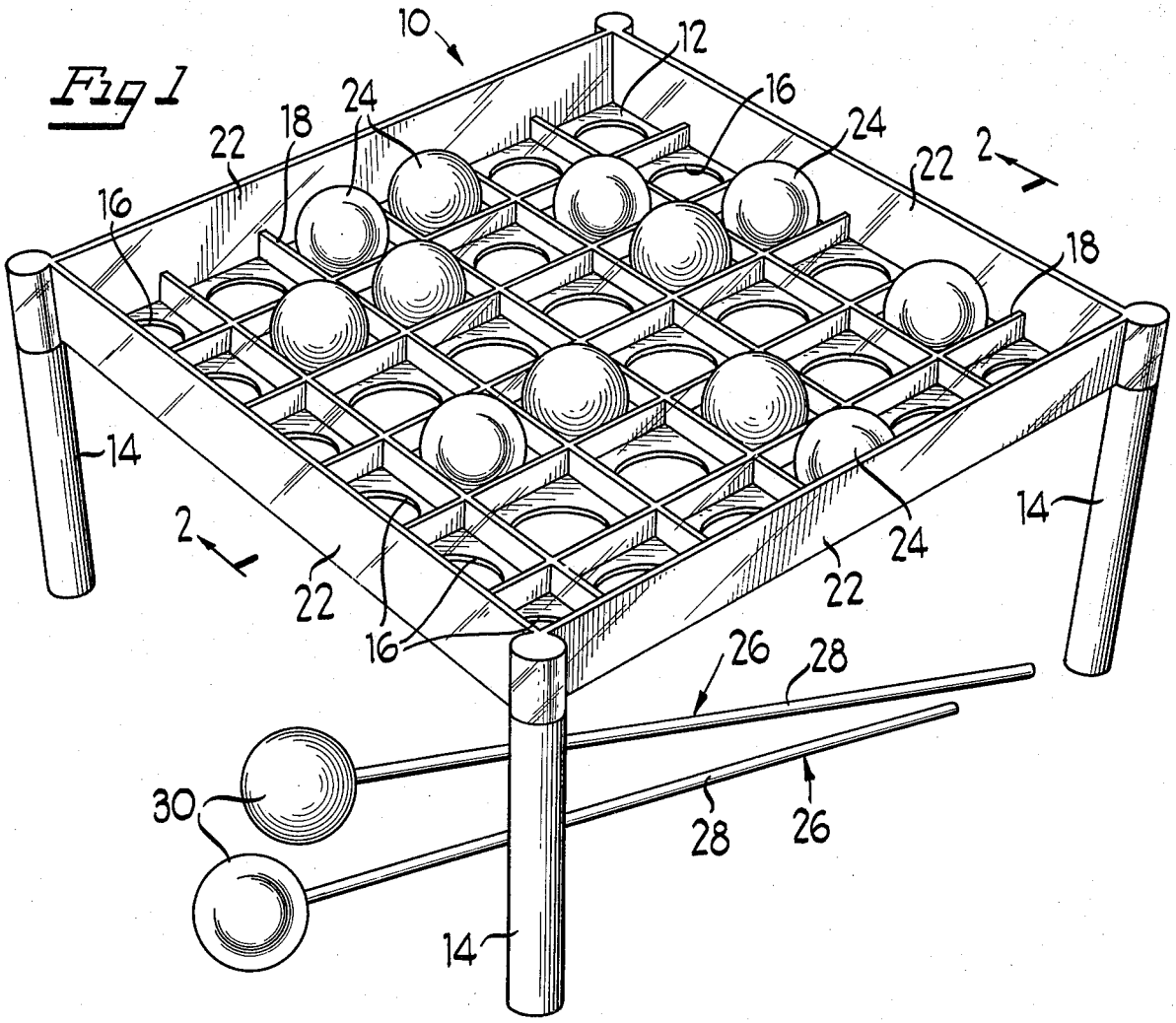
FIG. 1 is a perspective view of the game apparatus of the present invention showing a plurality of playing balls and a pair of impellers.

The present invention relates to a game playable on a theme of checkers or the like. The game apparatus, generally designated 10, comprises a frame generally rectangular playing surface 12 elevated above a supporting surface by four legs 14 disposed at the four corners of the frame. A plurality of apertures 16 are disposed in the playing surface 12 in a predetermined pattern such as the adjacent columns and rows shown. A plurality of upright partitions 18 are unitarily formed with the playing surface and extend upwardly from the playing surface 12 surrounding the apertures 16 to form rectangular compartments about the apertures.

Four retaining walls 22 extend upwardly around the outer periphery of the playing surface 12 a distance above the partitions 18 to retain a plurality of playing balls 24 upon the playing surface 12 and to complete the side walls of the peripheral compartments. The balls 24 each are larger in diameter than the apertures 16 and rest therewithin extending partially therethrough, as seen in FIG. 2.

A pair of hammer-like striking implements or impellers, generally designated 26, are utilized by the players to strike one of the balls from beneath the playing surface. The impellers 26 each include an elongated rod-like handle portion 28 and a striking head 30 affixed to one end of the handle 28. The head 30 is of the generally spherical shape and is composed of a suitable material in relation to an appropriate composition of the balls 24 to give the desired impelling effect.

Preferably, of course depending upon the scheme of play, the balls 24 are coded, as by colors, to the different players of the game, similar to the black and white colors commonly used for checkers. If desired, the heads 30 on the ends of the impellers 26 can be similarly coded.

Figure 2:
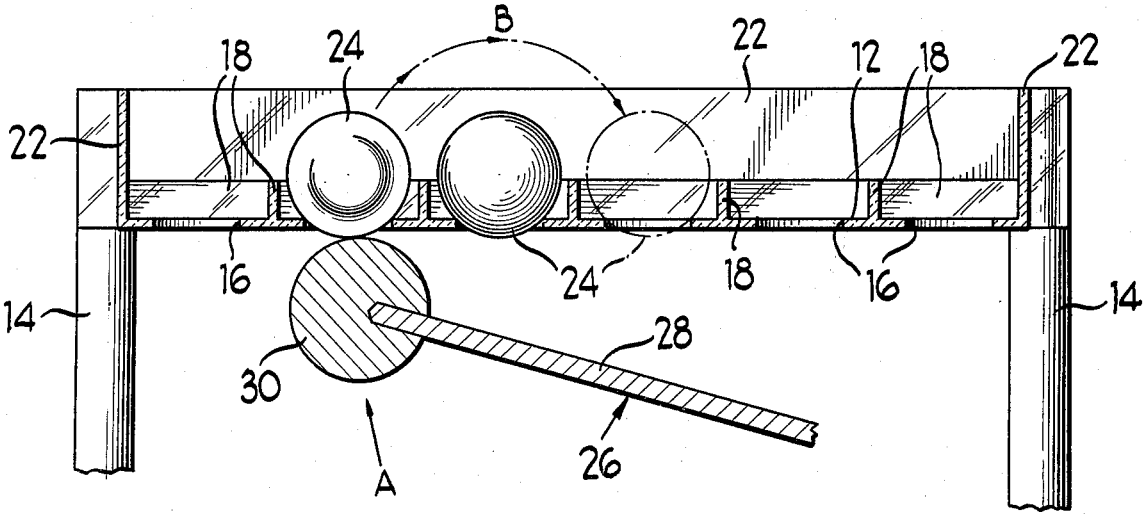
FIG. 2 is a vertical sectional view taken approximately along line 2—2 of FIG. 1, and additionally showing somewhat schematically the manner in which a ball is struck for jumping another ball.

Referring to FIG. 2, a player manually holding the impeller 26 by the handle portion 28 strikes a ball 24 of his color from beneath the playing surface, in the direction of arrow A, with the object of propelling the ball 24 in a manner shown by the trajectory arrows B to jump an opposing player's ball and thereby remove it from play.

It will be readily apparent that with the above exemplary structure can be played with a checkers type scheme where the object is to eliminate the opposing player by removing all of his balls from play on the playing surface. However, other schemes of play are afforded by the disclosure herein. Other predetermined patterns of apertures may be used where the playing pieces are struck from beneath the playing surface through the apertures to move the playing pieces along the predetermined pattern, jumping opposing players balls, and the like.

The foregoing detailed description has been given for clearness of understanding only and no unnecessary limitations should be understood therefrom as some modifications will be obvious to those skilled in the art.

We claim:

1. A game apparatus comprising, in combination:

a frame structure defining a raised playing surface having a plurality of circular apertures therein arranged in a predetermined pattern;

a plurality of playing balls of a diameter larger than the diameters of said apertures so as to be capable of resting therein and having a portion thereof extending below the playing surface;

a plurality of upright partitions surrounding said apertures to define compartments thereabout to facilitate positive positioning of the balls in the apertures; and at least one hand-held impelling implement including a handle portion and a spherical head portion for use by the players of the game to strike a playing piece by direct physical contact from beneath the playing surface through the apertures to provide an element of manual dexterity for moving the playing pieces over the pattern of apertures or over other playing pieces.

2. The game apparatus of claim 1 wherein said apertures are positioned in a checker board type pattern.

3. The game apparatus of claim 2 including upstanding peripheral wall means about the playing surface higher than said partitions to facilitate retaining the balls on the playing surface.

4. The game apparatus of claim 3 wherein said head portion is approximately the same size as the playing pieces.

* * * * *